US008807035B2

(12) United States Patent
Leonhardt

(10) Patent No.: US 8,807,035 B2
(45) Date of Patent: Aug. 19, 2014

(54) OPTIMIZED REGISTER CONTROL PROCESS IN A SHEET-FED PRINTING PRESS

(75) Inventor: Holger Leonhardt, Meckesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 614 days.

(21) Appl. No.: 12/564,136

(22) Filed: Sep. 22, 2009

(65) Prior Publication Data

US 2010/0071576 A1 Mar. 25, 2010

(30) Foreign Application Priority Data

Sep. 22, 2008 (DE) ..... 10 2008 048 284

(51) Int. Cl.
*B41L 3/02* (2006.01)

(52) U.S. Cl.
USPC ..... 101/486; 101/481; 101/246; 101/248

(58) Field of Classification Search
USPC ..... 101/486, 248, 485, 481, 286, 246, 225
See application file for complete search history.

(56) References Cited

U.S. PATENT DOCUMENTS

| | | | | |
|---|---|---|---|---|
| 4,221,165 | A * | 9/1980 | Ericsson | 101/126 |
| 4,484,522 | A | 11/1984 | Simeth | |
| 2002/0053297 | A1* | 5/2002 | Bosen et al. | 101/486 |

FOREIGN PATENT DOCUMENTS

| | | | |
|---|---|---|---|
| DE | 3136703 | C1 | 11/1982 |
| DE | 19628410 | A1 | 1/1998 |
| DE | 10334230 | A1 | 2/2004 |
| DE | 102005042284 | A1 | 3/2007 |
| DE | 102005046232 | A1 * | 3/2007 |
| JP | 62253451 | A | 11/1987 |
| JP | 62253453 | A | 11/1987 |

OTHER PUBLICATIONS

German Search Report dated Jul. 1, 2009.

* cited by examiner

*Primary Examiner* — Matthew G Marini
(74) *Attorney, Agent, or Firm* — Laurence A. Greenberg; Werner H. Stemer; Ralph E. Locher

(57) ABSTRACT

A method for setting position register and color register in a sheet-fed printing press having a control computer, which provides for one setting operation, in which both position and color register are set by the control computer. For the purposes of the setting, both the register setting elements in the printing units and the setting elements in the feeder are used. The invention is distinguished by the fact that before carrying out the setting operations, during the calculation of the travels for the register setting elements and setting elements in the feeder, an optimization comprising the travels of the register setting elements and the setting elements in the feeder is carried out in the computer.

11 Claims, 2 Drawing Sheets

OPTIMIZED REGISTER CONTROL PROCESS IN A SHEET-FED PRINTING PRESS

CROSS-REFERENCE TO RELATED APPLICATION

This application claims the priority, under 35 U.S.C. §119, of German patent application DE 10 2008 048 284.6, filed Sep. 22, 2008; the prior application is herewith incorporated by reference in its entirety.

BACKGROUND OF THE INVENTION

Field of the Invention

The present invention relates to a method for the setting position register and the color register in a sheet-fed printing press having a control computer, in which, in one setting operation, both position and color register are set by the control computer and, for the purposes of the setting, both the register setting elements in the printing units and the setting elements in the feeder are used.

The correct setting of color register and position register is important in sheet-fed offset rotary presses in order to obtain a high-quality printed product. Here, position register is understood to mean the position of the printed image in relation to the edges of the printed sheet, while color register is understood to mean the position of the individual color separations in relation to one another.

The prior art discloses some open-loop and closed-loop control systems for position register and color register in sheet-fed printing presses. Such a closed-loop control system is described, for example, in German published patent application DE 103 34 230 A1. There, a device is provided in a sheet-fed printing press which is able to effect a correction to the position of the printed image in relation to the edges of the sheet. That control system deals in particular with the position of the first color separation on the sheet. In order to be able to correct this position, an open-loop control system is proposed which is not only suitable to lay individual color separations exactly over one another but which also ensures that the first color separation reaches the required point in correct register. In order that the first color separation is brought in accurate register to the desired point on the printed sheet, use is made of corresponding setting elements in the press. For instance, it is possible for the plate cylinder of the first printing unit to be displaced in order to print the first color separation with accurate register. In the case of a plurality of printing units arranged one after another, all the other plate cylinders are then displaced correspondingly in order that the reference and therefore the color register of the various color separations in relation to one another is maintained. Another possibility is to use the feeder for setting the position of the first color separation on the printed sheet in the first printing unit. Via actuating signals, the effect here is that the printed sheet is transferred to the first impression cylinder in a position such that an accurate-register color separation is printed without any special adjustment of the plate cylinder in the first printing unit. However, there is also the possibility of acting via actuating signals simultaneously both on the feeder and on the impression cylinder of the printing unit and of effecting the accurate-register position of the first color separation on the printed sheet in the first printing unit. Furthermore, in DE 103 34 230 A1 it is proposed to make corrections to the circumferential, lateral and diagonal register via the front and side lays of the feeder. It is also possible for a separate pregripper drive to be provided, which permits compensation for the circumferential components of the register via the adjustment of the phase angle of the pregripper. This means that a large number of possible control actions with a corresponding number of travels during the adjustment are proposed. However, in this case no account is taken of the problem that the travels of the individual setting elements can be of different lengths, and thus a correspondingly long setting operation elapses until the correct color register and position register setting is reached, since the longest travel determines the overall time.

In order to shorten the travels during the setting of the color register, the Japanese patent JP 62-253451 proposes controlling the position of the individual color separations in relation to one another in accurate register to a virtual standard color. In principle, during the color register control, one of the colors, for example the color black or the color in the first printing unit, is chosen as the standard color, the deviations of the other color separations from this standard color being determined and the deviations determined in this way in relation to the standard color being compensated by adjusting the circumferential, lateral and diagonal register in the press. However, this can lead to some register motors having large travels, depending on different deviations, while others barely have to move in the event of small deviations. However, the longest travel then determines the length of the entire color register setting operation. In JP 62-253451, it is therefore proposed to determine the maximum deviation with respect to the position of two color separations over all the color separations and then to halve this maximum travel in the computer and at this point to define a virtual standard color. All the other color separations are then controlled to this virtual standard color, so that the maximum travel for a register motor is halved. However, JP 62-253451 relates only to the control of color register without taking any account of the control of position register, that is to say the position of the individual color separations and therefore of the printed image in relation to the edges of the printed sheet.

SUMMARY OF THE INVENTION

It is accordingly an object of the invention to provide an optimized register control for sheet-fed printing presses which overcomes the above-mentioned disadvantages of the heretofore-known devices and methods of this general type and which provides for a method for setting color register and position register in a sheet-fed printing press that performs the setting of color register and position register as quickly as possible.

With the foregoing and other objects in view there is provided, in accordance with the invention, a method for setting a position register and a color register in a sheet-fed printing press having printing units with register setting elements, a feeder with setting elements, and a control computer configured to control a travel of the register setting elements and a travel of the setting elements of the feeder. The novel method comprises:

prior to carrying out a setting operation, calculating with the control computer required travels for the register setting elements and the setting elements in the feeder, and carrying out an optimization of the travels of the register setting elements and the setting elements in the feeder; and then carrying out the setting operation by setting the position register and the color register with the control computer and thereby using the register setting elements in the printing units and the setting elements in the feeder and the optimized travels thereof.

In other words, the objects of the invention are achieved with a method that is suitable, in particular for setting color register and position register in sheet-fed rotary printing presses which have a register sensor, with which, in the last printing unit, the position of the color separations in relation to one another and the position of the printed image in relation to the edges of the printing material can be registered. The measured values registered in this way are fed to the control computer of the printing press in order to be able to set color register and position register appropriately. According to the invention, in order to correct deviations in the case of color register and position register, both the register setting elements in the printing units and also setting elements in the feeder are used. If an actuating operation is to be performed in order to correct color register and position register, then the deviations determined are distributed to the travels both for the register setting elements and for the setting elements in the feeder. According to the invention, the computer performs optimizations via the travels of the register setting elements and the travels of the setting elements in the feeder. This means that all the setting elements involved in the setting of color register and position register and their travels are optimized together, in order in this way to arrive at a particularly quick adjustment operation.

In accordance with an added feature of the invention, the optimization is a distance optimization. In this case, firstly the lengths of the travels of the register setting elements and of the setting elements in the feeder are calculated. In order to keep the travels as short as possible, a virtual adjustment line is calculated, to which the individual color separations and the position of the sheet must be moved. In this way, all the travels with respect to position of the color separations in relation to one another and the position of the printed image on the sheet are halved to a minimum. The position of the color separations in relation to one another is in this case compensated by the register setting elements in the printing units, while the position of the sheet with respect to the virtual line is compensated by means of adjustment in the feeder. This means that both the adjustment in the printing units and the adjustment in the feeder are optimized simultaneously and over all the travels.

In accordance with an additional feature of the invention, the optimization of the travels is a time optimization. In the case of this process, in addition to the length of the individual travels, account is also taken of the time needed by the individual setting elements in order to bring about the individual travel. This means that fast adjusting elements can also travel over correspondingly longer travels in the same time, while slow and sluggish adjusting elements cover correspondingly shorter travels in the same time.

Advantageously, provision is additionally made that, in order to set position register and color register, register adjusting motors in the printing units of the press and side lays or an adjustment of the pregrippers in the feeder of the press are used. The adjustment is thus performed in a combined manner by the motors for lateral, circumferential and diagonal register and also by the motors for the adjustment of the side lays for the lateral movement of the printing material in the feeder or for the adjustment of the pregrippers for circumferential and skewed position corrections in the feeder. Thus, all the setting devices in a sheet-fed printing press which act on the position of the printed image and the individual color separations with respect to the printing material are brought into play.

In accordance with a further refinement of the invention, provision is made that, depending on the measured deviations, firstly an actuating vector for circumferential, side and skew register and for the side lays and the pregripper control in the feeder is determined in the control computer. This calculated actuating vector contains the entire travel of the actuating motors involved in an adjustment operation. This actuating vector is then distributed appropriately proportionally to the individual motors of the register adjustment and the adjusting motors in the feeder. As already described, the actuating vector can be distributed uniformly to all the drives of the register motors and the side lays or the pregripper control in the feeder, if these operate with comparable adjustment speeds. If, however, the adjustment characteristics of the drives involved in the adjustment operation are considerably different, then instead time optimization should be chosen, which takes into account the different speeds and therefore adjustment characteristics of the drives involved in the adjustment operation. A particularly quick adjustment operation is therefore ensured.

In accordance with another feature of the invention, provision is made that, for the calculation of the travels, effects of the adjustment on the printing process are taken into account. For example, an adjustment of the pregrippers or a side lay in the feeder does not lead to ghosting during the printing operation in the press, whereas this is often the case during adjustment by the register drives. This makes it appear to be advantageous to weight the proportion of the entire travel for pregrippers and side lay device in the feeder more highly as compared with the travels for circumferential, lateral, skew register, so as not to get any adjustment-induced disadvantages as a result of ghosting and in this way to impair the print quality.

Other features which are considered as characteristic for the invention are set forth in the appended claims.

Although the invention is illustrated and described herein as embodied in an optimized register control in sheet-fed printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
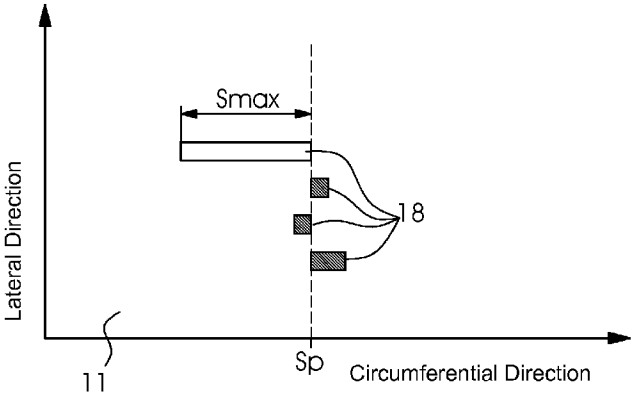
FIG. 1 PRIOR ART
FIG. 1 is a plan view of a sheet showing an adjustment of color register and position register according to the prior art.
Figure 3:
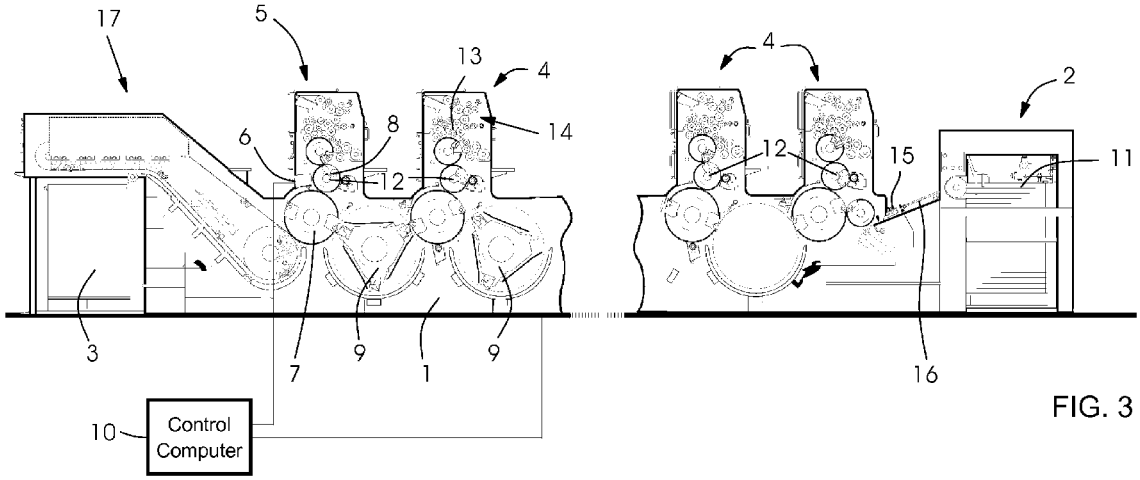
FIG. 3 is a side elevation of a sheet-fed printing press for carrying out the optimization according to the invention of the travels during a color and position register correction.

Referring now to the figures of the drawing in detail and first, particularly, to FIG. 1 thereof, there is shown a sheet 11 which has been measured by a register sensor 6 in a sheet-fed printing press 1 (cf. FIG. 3). The deviations 18 determined in the process are in this case referred to an intended position Sp, which indicates the desired position of the printed image in relation to the side edge of the sheet 11 in the circumferential direction. In FIG. 1, the greatest deviation from the intended position Sp is determined in the color separation of the "yellow" printing ink. This greatest deviation 18 is identified by Smax in this case. In order thus to correct all the color separations in FIG. 1 with accurate color register and position register to the intended position Sp, the yellow color separation must be corrected by the maximum travel Smax. This means that the travel Smax, which is much longer as compared with the other color separations, defines the total length of the adjustment operation, so that a rather long adjustment operation is necessary. This procedure corresponds to the known prior art.

Figure 2:
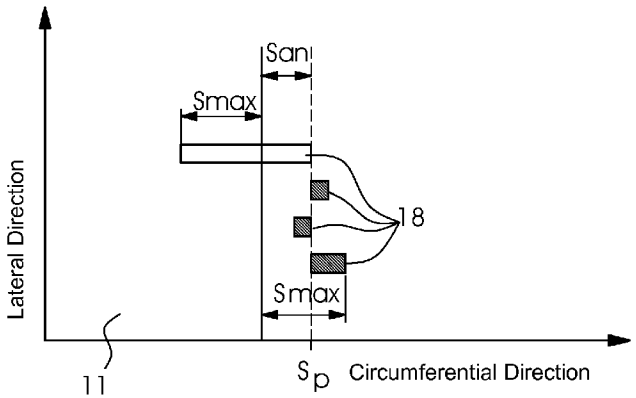
FIG. 2 is a plan view of a sheet showing color and position register adjustment optimized over all the travels.

As opposed to the procedure in FIG. 1, by means of the procedure according to the invention according to FIG. 2, the adjustment operation is substantially shortened and optimized. In FIG. 2, all the deviations 18 of the color separations with respect to the intended position Sp, which identifies the desired register position of the printed image in relation to the side edge of the sheet 11 in the circumferential direction, are also to be corrected. However, in FIG. 2, optimization over all the travels of the adjusting elements involved is carried out. Account is taken not only of the travels of the register drives in the printing units 4, 5 but also of the travels of the pregrippers in the feeder 2. In addition, to this end, by means of the register sensor 6, firstly the deviations 18 of the individual color separations with respect to the intended position Sp are determined. However, an optimization of the distances over the determined deviations 18 is then carried out, a virtual intended position illustrated by a continuous line being calculated as a function of the maximum determined positive and negative deviations 18 from the intended position Sp. The corresponding travels of the register setting motors in the printing units 4, 5 are then calculated on the basis of this virtual intended position, which results in a halved maximum travel Smax for the largest travel of the color yellow. In order, in addition to the color register correction effected in this way, also to ensure the position register correction with respect to the side edge of the printing material 11 in the circumferential direction, the distance between the virtual intended position and the actually desired intended position Sp, shown dashed, is calculated as San. This travel San is then the feeder travel. This means that the feeder travel San is carried out by the pregrippers in the feeder 2 so that, after the common adjustment by the register motors 12 in the printing units 4, 5 and the pregrippers 15 in the feeder 2, complete position register and color register correction, which leads to the shortest travel during the distance optimization proposed, has been carried out. While, in the circumferential direction, the feeder travel San has been compensated by an adjustment of the pregrippers, in the lateral direction, the side lay in the feeder 2 has been adjusted appropriately in order to compensate for the feeder travel San. In the case of a skew register correction, the adjustment in the feeder 2 is made by means of a skewed setting of the pregrippers 15. The adjustment operations in the feeder 2 and in the printing units 4, 5 can proceed simultaneously, so that a correspondingly faster adjustment operation results.

FIG. 3 depicts a sheet-fed printing press 1 which has a plurality of printing units 4, 5. In the feeder 2, during the printing operation, sheets 11 are removed, separated and fed over a suction tape table 16 to a first printing unit 4 of the press 1. In this case, at the output from the suction tape table 16 and before the first printing unit 4 there is arranged a side lay, which is able to align the incoming sheets 11 laterally in both directions. In this way, the lateral register, that is to say the position of the printed image on the sheet 11, can be changed. The transfer to the first printing unit is carried out via a cylinder having pregrippers 15, these pregrippers 15 being adjustable in the circumferential direction and diagonally in order to adjust the circumferential and skew register. In the printing units 4, 5, the sheets 11 are then printed with the individual color separations and, in the delivery 17, are deposited on a delivery stack 3. Between the printing units 4, 5, the transport of the sheets 11 is carried out by means of transport cylinders 9 arranged between them. Each of the printing units 4, 5 has an inking unit 14, with which the printing plate on the respective plate cylinder 13 is inked. From the plate cylinder 13, the printing image is in each case transferred to a blanket cylinder 8 which, together with an impression cylinder 7, forms the press nip. In this press nip, the sheets 11 are printed with the respective color separation. Provided in the printing units 4, 5 are register motors 12, which are able to adjust the lateral position and the circumferential position of the plate cylinders 13, in order to correct the color register, that is to say the position of the color separations in relation to one another. Furthermore, the printing units 4, 5 can also have a skew register adjustment. In the last printing unit 5, there is additionally provided a register sensor 6, which registers position register and color register marks on the printing material 11, in order in this way to determine deviations with respect to color register and position register. The deviations 18 determined in this way are transmitted by the register sensor 6 to a control computer 10 which controls the press 1. In the control computer 10, the deviations 18 determined are then evaluated and appropriate travels are determined for the register motors 12 and the adjusting elements in the feeder 2, such as the side lays and the pregrippers 15. In this case, the optimization can be, for example, a distance optimization as illustrated in FIG. 2. The optimized travels calculated in the control computer 10 are then sent as adjustment signals to the register motors 12 and adjusting elements in the feeder 2, in order in this way to effect the optimized adjustment operation to correct for position register and color register. This leads to substantially faster color register and position register corrections than in the prior art.

The invention claimed is:

1. A method for setting a position register and a color register in a sheet-fed printing press having printing units each with respective register setting elements, a feeder with setting elements, and a control computer configured to control a travel of the register setting elements and a travel of the setting elements of the feeder, the method which comprises:

prior to carrying out a setting operation, calculating with the control computer required travels for the respective register setting elements in each of the printing units and the setting elements in the feeder for correcting register problems between the register setting elements and the feeder, and carrying out an optimization of the travels of the respective register setting elements simultaneously with the travels of the setting elements in the feeder; and carrying out the setting operation by setting the position register and the color register with the control computer and thereby using the respective register setting elements in the printing units and the setting elements in the feeder and the optimized travels thereof.

2. The method according to claim 1, wherein the optimization is a distance optimization.

3. The method according to claim 1, wherein the optimization is a time optimization.

4. The method according to claim 1, wherein the setting operation for setting the position register and the color register comprises operating register adjusting motors in the printing units and side lays or an adjustment of pregrippers in the feeder of the printing press.

5. The method according to claim 1, which comprises registering position register deviations and color register deviations in the printing press by way of a register sensor and transmitted corresponding signals from the sensor to the control computer.

6. The method according to claim 5, wherein the computer performs the optimization of the travels on a basis of deviations transmitted by the register sensor.

7. The method according to claim 5, which comprises, depending on the measured deviations, firstly determining in the control computer an actuating vector for circumferential, lateral, and skew register and for the side lays and a pregripper control in the feeder.

8. The method according to claim 7, which comprises distributing the travels required for the correction as uniformly as possible to all drives for circumferential, lateral, skew register, and side lays and pregripper control in the feeder.

9. The method according to claim 1, wherein the optimization is a time optimization of the travels, and the adjustment characteristics of the drives for circumferential, lateral, skew register, and the side lay and the pregripper control in the feeder are taken into account in the optimization.

10. The method according to claim 1, which comprises, for the calculation of the travels, taking into account effects of the adjustments on the printing process.

11. The method according to claim 10, which comprises weighting a proportion of the travel for pregrippers and side lay device in the feeder more highly than the travels for circumferential, lateral, and skew register.

* * * * *